US005196156A

United States Patent [19]

Gage et al.

[11] Patent Number: 5,196,156

[45] Date of Patent: Mar. 23, 1993

[54] ROD COOLING SYSTEM

[75] Inventors: Charles H. Gage, Westborough; Alfred R. Leger, North Grafton, both of Mass.

[73] Assignee: Engineered Production Increase, Inc., North Grafton, Mass.

[21] Appl. No.: 788,805

[22] Filed: Nov. 7, 1991

[51] Int. Cl.[5] ..... C21D 9/56

[52] U.S. Cl. ..... 266/106; 266/103

[58] Field of Search ..... 266/106, 103, 111, 102

[56] References Cited

U.S. PATENT DOCUMENTS 4,023,392 5/1977 Fujita et al. ..... 266/106

4,448,401 5/1984 Jalil et al. ..... 266/106

*Primary Examiner*—Scott Kastler

*Attorney, Agent, or Firm*—Barlow & Barlow, Ltd.

[57] ABSTRACT

Cooling system for use in a rod rolling mill having a laying reel and an elongated conveyor onto which the rod is deposited in a pattern of overlapping offset rings, the conveyor having a section consisting of spaced, parallel transverse shafts bearing radially-extending disks whose arcuate upper peripheries support the rings in driving relationship for movement of the rod along the conveyor and for introducing cooling air under the rings for flow in a confined space thereunder.

4 Claims, 2 Drawing Sheets

ROD COOLING SYSTEM

BACKGROUND OF INVENTION

One of the most important products produced in a steel mill is rod in sizes varying from 3/16" to 1" and varying in metallurgical characteristics that depend on the use for which the rod is intended. Small sizes are often drawn into wire, while the larger sizes are often used in screw machines for producing bolts and the like. It is desirable, therefore, that a given rod mill not only be able to produce good quality rod over the entire range of commercial sizes, but also over the entire range of types of steel, including low carbon, high carbon and alloy steels.

Besides the need for obtaining this versatility in a rod mill, the improvements made in the roll stands and the guide equipment have allowed higher and higher rolling speeds (in excess of 350 feet per second), which, of course, has resulted in problems in the downstream handling of the hot rod. Generally speaking, it is easily possible to quickly cool the rod in water boxes sufficiently to permit it to be coiled in a pouring or laying reel, but the major problems that have developed have to do with cooling subsequent to coiling under controlled conditions to obtain a variety of desired metallurgical characteristics. The development of the Stelmor process by the Morgan Construction Company of Worcester, Mass., has gone far to improve this desired control of the cooling and this process would be adequate if the rod mill were used for only a limited number of types of rod. Unfortunately, present day steel mills are required (for reasons of economy) to not only produce rods over a wide range of sizes and steel types, but also to be changed from one type to another very rapidly. Also, metallurgical and mechanical uniformity of the rod product have become important components in judging the acceptability of rod quality.

Now, in a typical rod mill the cooling takes place on an elongated conveyor on which the coil is dropped from a laying reel as the conveyor moves, so that the rod lies on the conveyor in overlapping offset rings or coils. Cooling air is provided to the underside of the conveyor and flows upwardly through the staggered rings of rod. By varying the air flow at various positions along the length of the conveyor, it is possible to control the rate of cooling to a certain extent.

Unfortunately, this general construction of air-cooled conveyor system does not render the rod mill capable of producing the wide range of sizes and metallurgical types that is most desirable in order to use the rod mill most efficiently. This is largely due to the structure of the conveyors that have been used in the prior art systems. To begin with, these conveyors have consisted of the chain type and the roller type.

The chain type cooling conveyor has consisted of sprocket-driven chains which have upwardly-extending dogs that engage the rings of rod and drag them along over support rails. The roller type has consisted of spaced, parallel driven rollers that support the series of rings and move them along the conveyor.

Chain conveyors have more efficiency than the roller type, since they generally have a gap between the rod stock and the air nozzle opening. This gap allows air to flow both over and under the conveyed rod stock. The number of nozzles, their angles, and the nozzle throat and exit configurations also contribute to the cooling rate. The chain-type conveyor allows more freedom longitudinally to place an optimum number, angle, and frequency of nozzles. Unfortunately, the chain-type conveyor has several major deficiencies. The chain dogs and skid rails tend to mark the rod stock, the dogs tend to group the rings in irregular patterns and the ring overlaps are fixed, i.e., do not move during transit. When the ring overlap points are fixed, the intersecting mass areas are difficult to cool. Cool chains also act as a heat sink and tend to cool stock more rapidly when it contacts the chain.

The present practice is to make the nozzle decks from castings. This practice limits the size and number of nozzles in each deck section. Roller conveyors, on the other hand, allow the overlapping rod rings to shift, since a speed change or a ring drop can be used to produce a ring overlap shift, thus optimizing the rod cooling pattern. The roller conveyor can maintain a uniform ring pattern, even when there is a ring shift. Such even ring patterns keep the rings open for free flow of air which enhances uniform rod cooling. An unmarked rod is a major criterion for prime quality rod and the roller-type conveyor is least likely to mark the rod, particularly when the rod is in the red-hot range. The roller-type conveyor allows the stock to be easily centered by "persuader" rolls, but persuader roll adjustment is limited by roller spacing. Present roller conveyor designs serve to limit cooling efficiency, because the roller acts as a dam and does not permit air to pass freely and effectively along the bottom side of the stock. Air can pass vertically through the stock or pass over the top. Some improvement in cooling between the rollers is done by causing turbulence in the air flow, for instance, by blowing the air under the roll and allowing it to eddy up and around the roller. Even with large amounts of air, achievable cooling rates are lower than over and under cooling done generally on chain-type conveyors. Too large a nozzle pressure with a shallow nozzle angle can cause the stock to lose traction and to slide in an uncontrolled manner on a roller type conveyor.

The concept of placing a cooling source over the conveyor is unacceptable, since such a system generally obstructs the visibility and prevents easy accessibility to damaged stock. Therefore, cooling air on all types of conveyors are restricted to doing so from the underside.

Where chain-type conveyors allow the rod rings to drag on surfaces (instead of skids), the resulting cooling efficiency is as low (if not lower) than with the roller-type conveyor.

During slow cooling processes, as compared with rapid cooling, radiant heat from the hot rod stock is contained within an enclosed conveyor, the conveyor top and side walls being usually insulated. The bottom of the conveyor usually contains the stock heat by blocking any direct radiation from escaping into the air chamber below. The rollers in such a slow-cool situation are subjected to high temperatures. Therefore, the rollers are usually oversized to prevent them from creeping or sagging. The ends of the rollers must either have water-cooled bearings or have finned ends to prevent overheated outboard bearings.

With the chain-type conveyor, the chains have limited life under slow-cool conditions, and chain length expands considerably, causing take-up and sprocket jamming problems. So slow-cool conveyors have at present been limited to the roller type. In such cases, the air nozzles are sometimes designed to limit radiation loss and are either placed under the rollers or have a nozzle-closing mechanism Nozzle patterns are usually fixed and generally supply more air to the edge of the ring pack where the stock is densest. One system has been known to use nozzle inserts or blocks to develop an operating pattern. Other systems have continuous nozzles running from side-to-side and rely on divided chambers under the conveyor deck to provide a greater air flow to the edge of the ring pack.

It can be seen, then, that a chain-type conveyor, when used in the "slow-cooling" processes, has a short life, while a roller-type conveyor under such conditions requires extraordinary complications in structure. At the same time, neither type of conveyor operates effectively under "rapid cooling" processes. It should also be pointed out that any attempt to extend the range of cooling capability by increasing the fan capacity is not an acceptable alternative, because of the cost of larger motors and the noise accompanying the use of larger fans. These and other difficulties experienced with the prior art devices have been obviated in a novel manner by the present invention.

It is, therefore, an outstanding object of the invention to provide a rod cooling system in which controlled cooling can take place over a wide range of sizes and metallurgical requirements.

Another object of this invention is the provision of a system for conveyor-type rod cooling which is efficient during both slow cooling and rapid cooling.

A further object of the present invention is the provision of a rod cooling system for a rolling mill, which system is simple and rugged in construction, which can be easily and inexpensively manufactured from readily-obtainable materials, and which is capable of a long life of useful service with a minimum of maintenance.

A still further object of the invention is the provision of an air-cooling system for a rolling mill which operates effectively with a minimum of fan capacity.

It is a further object of the invention to provide a cooling means for overlapping rod coils, wherein the contact points between coils are changed frequently and wherein cooling takes place equally at all parts of the coil.

Another object of the invention is the provision allowing for a flexible choice of nozzles along the length of the conveyor which optimizes air flow control.

Another object of the invention is the provision of a rod cooling conveyor whose active elements weigh less than the equivalent roller type element.

Another object of the invention is the provision of a rod cooling system that can be easily used in converting an existing rod cooling apparatus.

With these and other objects in view, as will be apparent to those skilled in the art, the invention resides in the combination of parts set forth in the specification and covered by the claims appended hereto.

SUMMARY OF THE INVENTION

In general, the present invention relates to a rod cooling system for receiving hot rod from a laying reel in a pattern of overlapping offset rings, the system consisting of a conveyor along which the rings are longitudinally moved. The conveyor has a section consisting of a plurality of spaced, parallel cylindrical shafts, wherein each shaft has a plurality of radially-extending disks whose peripheries have diameters that are substantially greater than the diameter of its shaft. Means is provided for driving the shafts, so that the upper peripheries of the disks move longitudinally of the conveyor to move the rings. Means are provided for supplying cooling air into a flow space defined by the surface of the shafts, the sides of the disks, and the underside of the rings.

More specifically, the means supplying the cooling air consists of a grid with nozzles lying between the shafts and having passages directing air along the flow space in a direction having a substantial horizontal component.

The nozzles are easily removable and interchangeable. The nozzle used in each position along the conveyor length or from side to side, can be varied for optimum metallurgical uniformity and cooling rate. Customizing the air flow by the type of nozzle used, controls the air flow in, around and above the ring pack which, in turn maximizes the air cooling efficiency.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
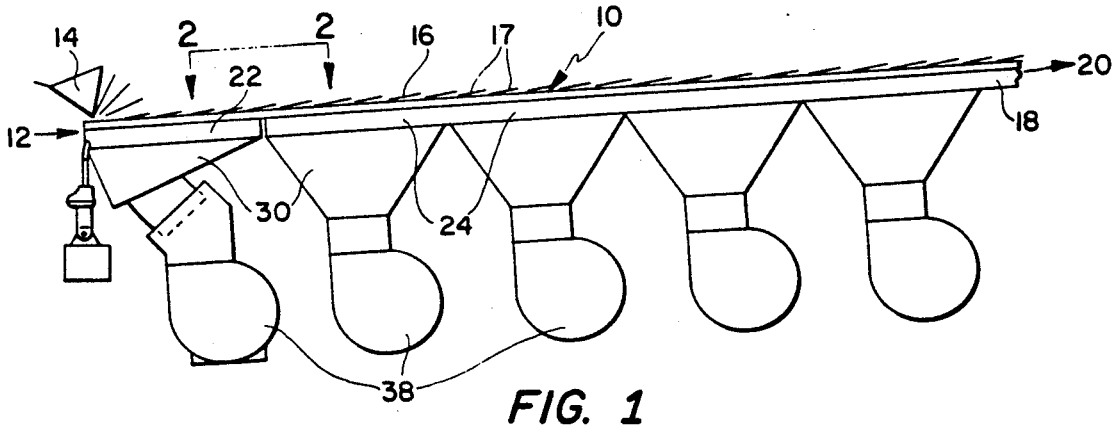
FIG. 1 is a front elevational view of a rod cooling system incorporating the principles of the present invention.
Figure 2:
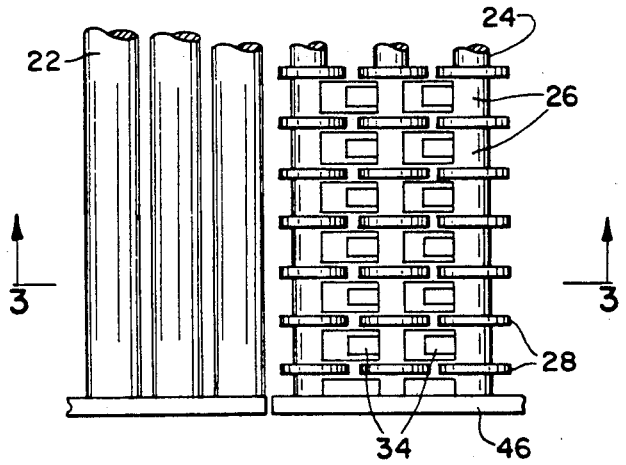
FIG. 2 is a plan view of a portion of the system, taken on the line 2—2 of FIG. 1.
Figure 3:
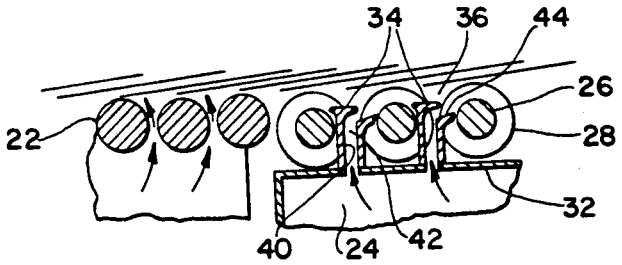
FIG. 3 is a vertical section view of a portion of the system, taken on the line 3—3 of FIG. 2.

Referring first to FIGS. 1-3, which best show the general features of the invention, the rod cooling system, indicated generally by the reference numeral 10, is designed for use in a rod rolling mill 12 having a reel 14 for receiving and coiling the rod 16. The system includes an elongated conveyor 18 for receiving the rod from the reel in the form of overlapping, offset rings and carrying it to a remote disposal position as at 20. The conveyor has an entry portion, generally desinated 22, underlying the reel that has a plurality of rotating rods 23 and the entry portion is followed by sequential cooling zone portions 24. Analagous systems are seen in U.S. Pat. Nos. 4,546,957 and 4,580,353. The conveyor 18 in the first zone portion has transversely-extending driven shafts 26 provided with a plurality of radially-extending disks 28 for receiving and supporting the rings on their upper arcuate peripheries or edges.

An air supply means 30 underlies the conveyor for supplying cooling air to the entry portion 22 and the zone portions 24. As is evident in FIG. 3, a grid 32 underlies the shafts and has nozzle-shaped slots or nozzles 34 for directing the cooling air upwardly at a small angle to the horizontal into spaces 36 defined by the disks 28, the grid 32 (with its nozzles 34),and the underside of the rings.

In the preferred embodiment of the invention, the reel 14 is of the laying type, and the air supply means includes centrifugal or axial fans 38. Each nozzle 34 is defined by two spaced, parallel surfaces 40, 42 extending at an acute angle to the vertical and by an aerodynamic 44 surface located at the exit of the slot into the said flow space 36 to produce substantial flow of air in a direction generally parallel to the direction of movement of the rings along the conveyor. Also, the entry portion 22 of the conveyor is tiltable to control the formation of the rings as the rod emerges from the reel 14. The reel deposits the rod 16 directly on the entry portion and this portion has more apertures whose total area is substantially larger than those of the first or second cooling zone 24, so that the density of the air is much higher than in the first or second cooling zone. This is done on occasion to cool the rod quickly to transformation. The nozzle exit angle may be varied or blocked entirely depending on the purpose in developing a three dimensional air flow pattern in and around the ring pack.

Figure 4:
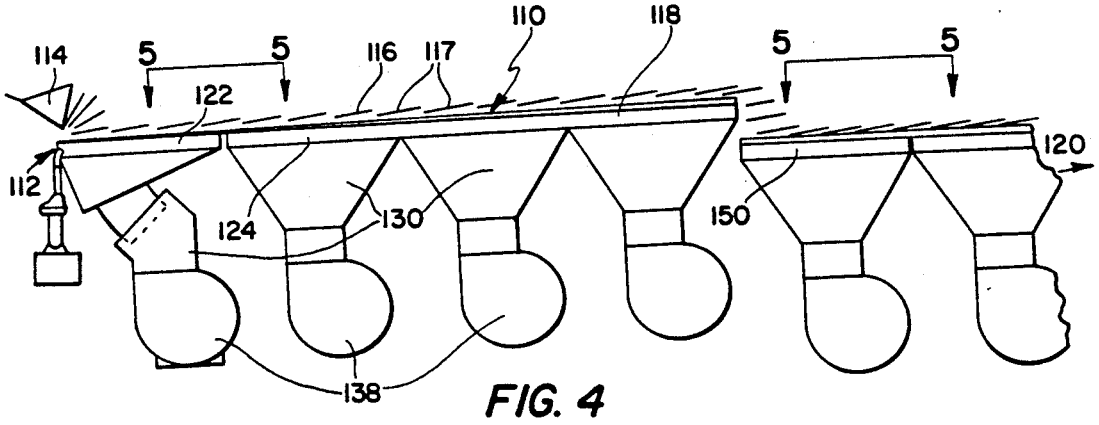
FIG. 4 is a front elevational view of a modified form of the invention.
Figure 5:
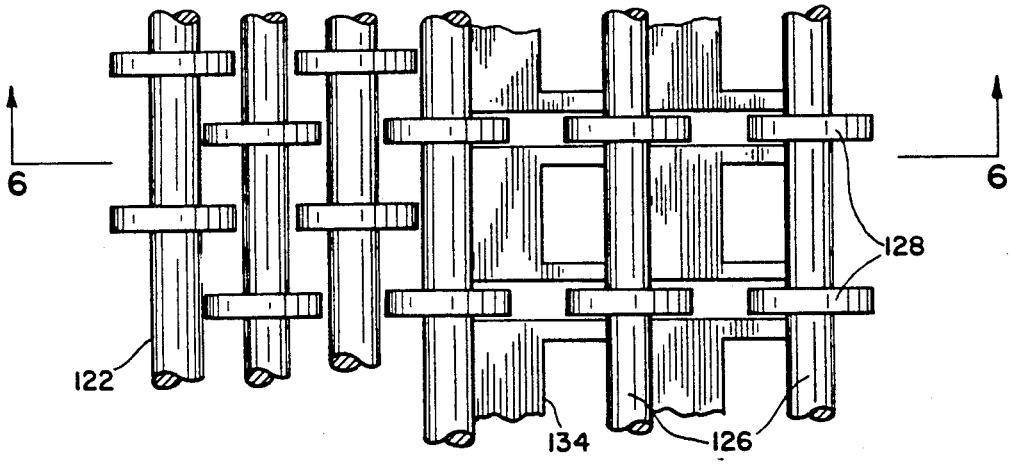
FIG. 5 is a plan view of the invention, taken on the line 5—5 of FIG. 4.
Figure 6:
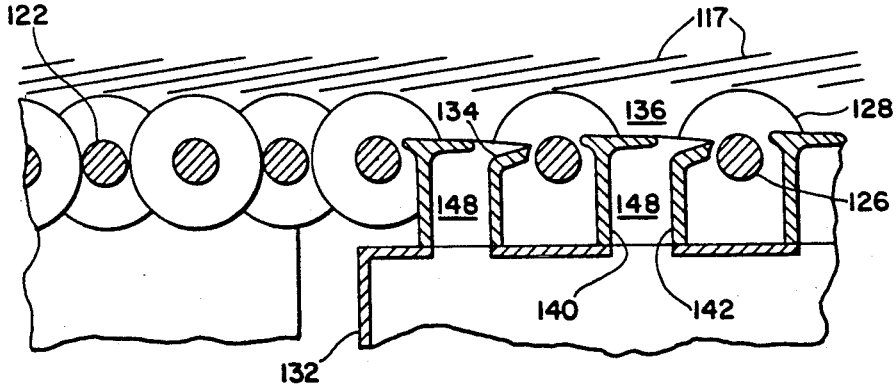
FIG. 6 is a vertical sectional view of the invention, taken on the line 6—6 of FIG. 5.

A modified form of the invention is shown in FIGS. 4–6, in which the rod cooling system 110 is shown as part of a rod rolling mill 112 and for receiving hot rod 116 from a laying reel 114 in a pattern of overlapping offset rings 117. A conveyor 118 is provided along which the rings are longitudinally moved to a disposal position 120. The conveyor has an entry portion 122 and a first cooling section 124 consisting of a plurality of spaced, parallel shafts 126 having cylindrical surfaces, each shaft having a plurality of radially-extending disks 128 each of which has a periphery whose diameter is substantially greater than the diameter of the surface of the shaft.

Means 146 is provided for driving the shafts, so that the surfaces of the upper peripheries of the disks move longitudinally of the conveyor to move the rings. Means 130 is also provided for supplying cooling air into the flow space 136 defined by the surface of the shafts 126, the grid 132 with its nozzles 134, the sides of the disks 128, and the underside of the rings 117. A secondary cooling section 150 is provided at the discharge end of the cooling section 124 and is located at a lower level to provide a drop for the rod rings for the purpose of re-arranging the crossover points in the strands. The spacing of the shafts in this section, are quite close (see FIG. 5) to prevent any pinching of the rod.

The means 130 for supplying the cooling air consists of nozzles 134 lying between the shafts 126 and having passages 148 directing air into the space 136 in a direction having a substantial horizontal component.

The operation and advantages of the present invention will now be readily understood in view of the above description. Referring to FIGS. 1, 2, and 3, the rod 16 arrives at the reel 14 from the rod mill 12 at a very high speed, after passing through water boxes (not shown) which serve to cool it to a temperature that is acceptable to the reel. The reel lays the rod in rings 17 on the entry section 22 and the movement of the conveyor 18 serves to arrange the strands in overlapping, offset coils. On occasion, the air supply means 30 passes cooling air through the apertures in the entry portion 22 to cool the rod quickly. In any case, the rings 17 move onto the cooling portion 24 where they receive further cooling air from the fan 38. The rings lie on the upper arcuate peripheries of the disks 28 which are moving longitudinally of the conveyor, because the shafts 26 on which they are mounted are rotated by the drive means 46. The nozzles 34, which extend vertically upwardly between the shafts 26, supply cooling air to the flow space 36 below the rings 17 and between the pairs of disks 28, the grid 34, and the surfaces of the shafts on which they are mounted. Because of the conformation of the spaced, parallel surfaces 40, 42 and the aerodynamic surface 44, the flow of air has a substantial horizontal directional component. In addition, the nozzles are formed as part of the grid 34 that extends from shaft to shaft and forms a floor for the space between the disks; the cooling air is, therefore, restrained to move longitudinally along the space under the rod pack.

The advantages of the invention will now be evident. Since the invention relates to the use of large disks mounted on a smaller diameter shaft, the multiple-disk shaft can be mounted with the disks either aligned or staggered. Aligned disks are spaced far enough apart to prevent pinching of the largest stock size. Each disk carries the stock over an arc on its upper periphery and this arc gives the stock forward motion without marking the rod rings 17. This arc can also act as a retarding brake, to prevent coil sliding movement, when high velocity air cooling flows are required for a fast cooling rate. Furthermore, the up-and-down motion provided by this arc tends to relocate the ring crossover points to obtain a more uniform cooling rate. The stock, therefore, rides on a surface made up of multiple arc surfaces. These arc surfaces carry the rod stock at a position that is well elevated above the disk shaft, so that cooling air can blow over and under the stock surfaces. Since the disks do not present a continuous surface laterally or longitudinally, the air is equally distributed, except in the limited areas where the disk arcs contact, support, and drive the stock.

The large number of disc arc serve to maintain the unit loading to a minimum, thus preventing distortion of the stock rings. The stock or ring pack can be easily centered by the use of persuader rollers along the sides of the conveyor. The disk shafts permit a considerable adjustment of such rollers. Since the upper disk peripheries have only limited contact time with the stock, the disks contact only a small portion of the stock and absorb very little heat, so that they do not cause any local cold areas.

Since only a relatively thin disk arc contacts the hot rod stock during a "slow" cooling process and since only a small portion of the disk shaft is exposed to radiation, the disk shaft will remain cooler than the stock. Because the shaft runs cooler, it can be smaller, because creep and sag are not appreciable factors. The outboard bearing will, therefore, require a minimum amount of finned air cooling, thus allowing the outboard bearings to be placed closer to the conveyor chamber. The overall length of the disk shaft can be shorter than in similar applications of rollers in a roller conveyor.

The nozzles 34 have bends in the throat to prevent loss of radiant heat during a "slow" cooling process. The disk shaft 26 also blocks radiant heat loss. Insulated covers and sidewalls can be combined with the shafts and the nozzle surfaces to contain the high temperature to assist in producing the slow cooling rate for the rod stock. Air space under the rings and above the nozzles helps insulate the rings during slow cooling.

Since the nozzles are placed between the disks and the shafts, directional air flow takes place between the disks. Dummy or blank nozzles can be used to reduce the air flow in the locations of the rod pack where it is thinnest or an increased nozzle size may be used where the rod pack is the densest. The nozzle angle can be varied to optimize the air flow in the ring pack. It is contemplated that the disk shafts and the high efficiency cooling will be used for a maximum of 90 feet following the rod laying area. Furthermore, air flow will be controlled in 10 to 30 foot lengths. The air supplied to these conveyor lengths will be controlled by dampers, vanes, or by individual blower units. Such controls will allow variation of the air flow, as well as full on-off control. The "full off" control enables the operator to completely cut off air to a given conveyor length for metallurgical reasons or to prevent convection air (during slow cooling) from flowing up or down through the nozzles. The conveyor chambers can be divided longitudinally into several compartments and air flow to these compartments can also be controlled by damper, vanes, or individual blower units.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Rod cooling system for use in a rod rolling mill having a reel for receiving and coiling the rod, comprising (a) an elongated conveyor for receiving the rod from the reel in the form of overlapping offset rings and carrying it to a remote disposal position, the conveyor including an entry portion underlying the reel followed by sequential cooling zone portions, the conveyor having transversely-extending driven shafts with a plurality of radially-extending disks for receiving and supporting the rings on their upper edges, (b) air supply means underlying the conveyor for supplying cooling air to the zone portions, (c) a grid underlying the shafts and having nozzles for directing the cooling air upwardly at a small angle to the horizontal into flow spaces defined by the disks and the underside of the rings, (d) each nozzle having a slot defined by two spaced, parallel surfaces extending upwardly and by an aerodynamic surface located at the exit of the nozzle into the said space to produce substantial flow of air in a direction generally parallel to the direction of movement of the rings along the conveyor.

2. Rod cooling system as recited in claim 1, wherein the reel is a laying head and wherein the air supply means includes powered fans.

3. Rod cooling system for use in a rod rolling mill having a laying reel for receiving and coiling the rod, the laying reel depositing the rod directly onto the entry portion of the cooling conveyor comprising (a) a longitudinally-extending conveyor having means for moving the rod and having transversely-extending parallel driven shafts with radial disks for receiving and supporting the rod as it moves from the laying reel in the form of overlapping offset rings, the disks having substantial depth and arcuate edges on which the rings are supported, (b) air supply means underlying the conveyor, the entry and first portions of the conveyor having a substantially denser volume of cooling air than the succeeding portions of the conveyor, (c) a grid underlying the shafts and having nozzle-shaped openings extending upwardly into a flow space defined by the surfaces of the shafts, the grid, the sides of the disks, and the underside of the rings, each opening being defined by two spaced, parallel surfaces extending upwardly with exit openings having one surface that extends at a small angle to the horizontal, and by an aerodynamic surface located at the exit of the opening into the said space to produce a substantial flow of air in a direction generally parallel to the movement of the rings along the conveyor.

4. Rod cooling system for receiving hot rod from a laying reel in a pattern of overlapping offset rings, comprising (a) a conveyor along which the rings are longitudinally moved, the conveyor having a section consisting of a plurality of paced, parallel shafts having cylindrical surfaces, each shaft having a plurality of radially-extending disks having peripheries whose diameters are substantially greater than the diameter of the surface of its shaft, (b) means driving the shafts, so that the upper peripheries of the disks move longitudinally of the conveyor to move the rings, (c) means supplying cooling air into a flow space defined by the surface of the shafts, the sides of the disks, and the underside of the rings consisting of nozzles lying between the shafts and having passages directing air in a direction having a substantial horizontal component, the nozzles forming part of a gird that extends from shaft to shaft, so that the shafts and grid form a substantially uninterrupted floor for the said space and means for varying the exit angle of the air flow at the nozzle across the width of the conveyor.

* * * * *